156-70

F351A OR 4,547,237

United States Patent [19]

Hendrickson

[11] Patent Number: 4,547,237

[45] Date of Patent: Oct. 15, 1985

[54] MANUFACTURE OF PLASTIC BAGS HAVING DRAWSTRINGS

[75] Inventor: Thomas C. Hendrickson, South River, N.J.

[73] Assignee: Colgate-Palmolive Company, New York, N.Y.

[21] Appl. No.: 73,286

[22] Filed: Sep. 7, 1979

Related U.S. Application Data

[63] Continuation of Ser. No. 827,673, Aug. 25, 1977, abandoned.

[51] Int. Cl.[4] ..... B31B 1/90

[52] U.S. Cl. ..... 156/70; 156/267; 229/63; 383/75; 428/77; 428/101; 493/225; 493/928

[58] Field of Search ..... 93/8 WA, 35 DS; 150/3, 150/11; 156/66, 69, 70, 250, 267, 269, 289, 291; 229/62, 63; 428/77, 101; 383/72, 75; 493/225, 928

[56] References Cited

U.S. PATENT DOCUMENTS

| | | | |
|---|---|---|---|
| 781,821 | 2/1905 | Glenwright | 156/70 X |
| 2,799,611 | 7/1957 | Dreisbach | 229/63 X |
| 3,284,267 | 11/1966 | Buck et al. | 156/70 X |
| 3,552,639 | 1/1971 | Meyer | 229/63 |
| 3,794,545 | 2/1974 | Lucas | 156/521 X |

*Primary Examiner*—Robert Dawson

*Attorney, Agent, or Firm*—LeBlanc, Nolan, Shur & Nies

[57] ABSTRACT

A drawstring is mounted near the open mouth of a plastic bag by a pressure sensitive tape that freely laterally encloses the drawstring except for projecting free ends, the tape being formed or treated so as to be non-sticky with respect to the drawstring. A high speed production method of making the bags comprises the steps of laying a continuous length of drawstring material across a series of spaced bags, applying strips of pressure sensitive tape to each bag to freely laterally enclose the drawstring length there and severing the drawstring length between bags.

5 Claims, 4 Drawing Figures

MANUFACTURE OF PLASTIC BAGS HAVING DRAWSTRINGS

This is a continuation of application Ser. No. 827,673 filed Aug. 25, 1977, and now abandoned.

This invention relates to the manufacture of plastic bags having close effecting drawstrings at their open ends and particularly to incorporation of the drawstrings with the empty formed but relatively limp bags during a stage of manufacture.

There has been an increasing use of relatively large plastic bags such as for trash, leaf and like collection and various modes of closing the open ends after filling has been suggested. Separate ties have been used, but they may be lost and are susceptible to sliding off the slipper bag surfaces. Provision of retained drawstrings has been proposed but known modes of mounting the drawstrings usually are difficult or impossible to incorporate into high speed manufacturing systems, so that bags with the drawstrings mounted on them have been relatively expensive to make.

It is a major object of the present invention to provide a novel synthetic plastic bag assembly wherein at and generally along the open end of the bag retainer tape means extends coextensively with a drawstring for substantially the width of the bag in flat condition, opposite ends of the drawstring projecting sufficiently from opposite ends of the tape means to provide for grasping and tying and the intermediate portion of the drawstring enclosed by the tape means being otherwise freely movable relative to the bag wall and the tape means whereby the drawstring may be manipulated to effect a gathered closure of the bag end.

Pursuant to the foregoing and as a further object, the tape means is preferably a length of pressure sensitive tape capable of sticking tightly to the bag wall to laterally enclose and retain the drawstring on the bag but formed or treated so as not to stick to the drawstring.

Another major object of the invention is a novel method of applying a drawstring to a flat empty synthetic plastic bag wherein a drawstring longer than the width of the bag in flat condition, is laid across the flat bag adjacent and generally parallel to the open end of the bag so as to project beyond both opposite edges of the flat bag and then a tape such as pressure responsive tape having an intermediate longitudinal portion formed or treated so as not to stick to the drawstring is laid across the bag wall substantially coextensively with the drawstring portion overlying the bag wall so as to laterally enclose and retain the drawstring without bonding the drawstring to the bag wall.

Another object of the invention is to provide a novel method of applying drawstrings to a series of synthetic plastic bags at relatively high speed wherein a continuous length of drawstring is laid across a series of spaced bags, and strips of retainer tape such as pressure sensitive tape of predetermined length are applied to each individual bag to be substantially coextensive with and laterally enclose the drawstring portions overlying each bag, each tape being formed or treated so as not to bond to the drawstring, and then the drawstring length is severed between adjacent bags, leaving each bag with its individual drawstring projecting from both ends of the tape.

Further advantages will appear as the description proceeds in connection with the appended claims and the annexed drawings.

PREFERRED EMBODIMENTS

Figure 1:
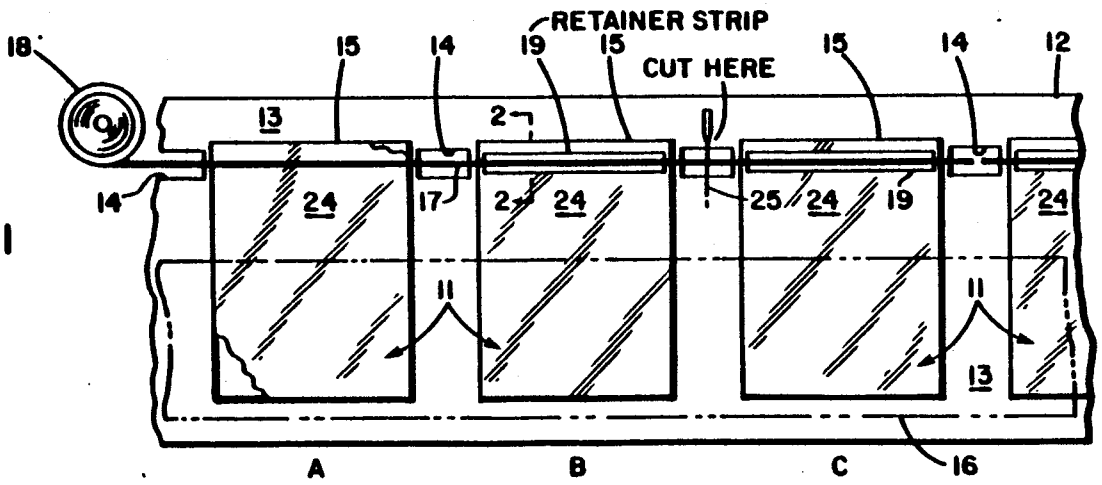
FIG. 1 is a plan view mainly diagrammatically illustrating the invention according to a preferred embodiment.

FIG. 1 shows a series of flexible walled synthetic plastics bags 11 in flat condition being conveyed through a drawstring applying station. The bags may be integral polyvinylchloride bags formed in any known manner. In practice the invention is applicable to any size bags, for example the conventional large trash bags that when flat are about 30 inches wide and 36 inches long.

In FIG. 1, preformed bags 11 are shown disposed in parallel spaced relation in alignment along a conveyor indicated at 12. Where the bags are the large trash bag type this could be a wide endless belt, the bags being suitably fed in sequence to lie upon the horizontally moving upper flight surface 13 in the desired spaced relation which may be about six to twelve inches. Belt 12 is suitably driven so that each bag passes through the positions indicated at A, B and C in FIG. 1. For a purpose to appear later, the belt 12 may be provided with a longitudinally aligned series of slots 14 in the spaces between adjacent bags. The open ends of the bags indicated at 15 are preferably in substantial alignment longitudinally of the belt surface 13, and the bags may be held immovably on the belt surface 13 as by a flat band indicated in chain lines at 16 moving at the same speed as belt surface 12 which may be, for example, the bottom horizontal flight of an endless belt above belt 12 driven at the same speed as belt 12.

The drawstring is applied by first feeding the leading end of a continuous length of flexible drawstring 17 from a supply coil 18 to overlie the bag at position A substantially parallel to an adjacent open end 15 indicated in FIG. 1. As belt surface 13 moves to the right in FIG. 1 drawstring 17 which extends across the bag width in contact with the bag will move at the same speed. At this point, the drawstring does not move relative to the bag. Any suitable mechanism such as a series of feed and guide rolls for transferring the drawstring from supply 18 to the belt surface and disposing it therealong in contact with the bags may be provided.

When each bag with the drawstring overlying it reaches the position B of FIG. 1 a predetermined length strip of tape 19 is applied to extend substantially the width of the bag longitudinally along the drawstring. Basically this tape is of such characteristics as to adhere or otherwise fasten to the underlying bag side wall above and below the drawstring so as to laterally enclose it but leaving the drawstring free of such attachment to either the bag or the tape. The length of tape section 19 is preferably about equal to the width of the bag in flat condition although it may be suitably shorter.

Figure 2:
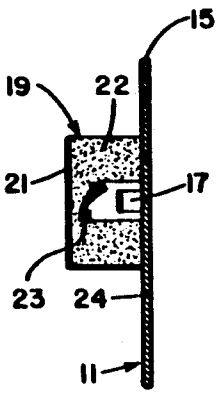
FIG. 2 is an enlarged section taken substantially on line 2—2 in FIG. 1 showing one form of tape and drawstring association.

For example, see FIG. 2, the tape 19 may consist of an outer synthetic plastic backing layer 21 and a pressure sensitive tacky or sticky layer 22, with a thin strip 23 of smooth synthetic plastic extending centrally of the sticky surface the entire length of the tape. This strip 23 which bonds immovably to the pressure sensitive layer is wider than the drawstring 17, so that when the tape is pressed onto the bag side wall 24 there will be no contact between drawstring 17 and the pressure sensitive layer although the tape will bond securely upon the bag above and below the drawstring. The drawstring is thereby confined by the tape and mounted on the bag, but remains capable of movement relative to the bag surface.

When each bag reaches the position C of FIG. 1, the drawstring 17 is severed about midway between that bag and the next adjacent upstream bag. The severance line is indicated at 25 in FIG. 1. As a result, each bag leaving position C will have an applied slidably mounted drawstring length that extends entirely across one side wall adjacent the open end with projecting opposite ends about three to six inches long available for the operator to grasp and manipulates to effect a gathered closure of the bags open end.

Any suitable mechanism may be provided for applying the tape and for severing the drawstring. For example, the modified pressure sensitive tape may be supplied for a supply coil from which is drawn and severed suitable tapes 19 and the severed tapes indexed to be applied in timed relation to the bags at position B. The drawstring severing action may be effected by suitable knife or rotary cutters acting periodically through slots 14, and if desired such severing may be effected when the bag is in position B and while the tape is being attached to the bag.

The starting plastic bags as above noted are the usual synthetic plastic bags, usually sheet polyvinylchloride or the like. The drawstring 17 is preferably a narrow web of synthetic plastics material, for example, about one-eighth to one-quarter of an inch wide. The tape 19 may be a conventional pressure sensitive tape modified by applying strip 23 as an isolating region along the center of the sticky layer. Ordinary string, twine or the like may be used for the drawstring.

During the foregoing the conveyor 12 may be moved either continuously or intermittently, with the various bag, drawstring and tape feeding means synchronized therewith.

Figure 3:
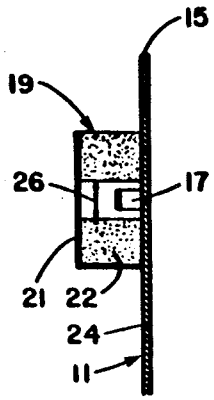
FIG. 3 is a similar enlarged section showing another form of tape and drawstring association.

FIG. 3 shows in another embodiment the isolating region of each tape section being formed by removing the pressure sensitive material along a longitudinal space 26, or in the alternative supplying backing 21 with spaced pressure sensitive layers defining non-sticky space 26 between them. Space 26 is wider than drawstring 17 so that when the tape is applied as in FIG. 3, the assembly is functionally the same as FIG. 2, the drawstring being free and isolated from the sticky tape surface.

Figure 4:
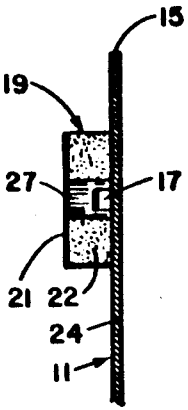
FIG. 4 is a similar enlarged section showing a further form of tape and drawstring association.

Similarly, see FIG. 4, the tape 19 may be sprayed along its medial length with a band 27 of any material that will render the pressure sensitive material therebeneath ineffective to attach to the drawstring.

Another available arrangement is to coat the drawstring with a suitable release agent which renders the drawstring incapable of sticking to the pressure sensitive layer of the tape.

While pressure sensitive retainer tapes are disclosed. other tapes secured to the bags as by heat fusing or other adhesives may be employed within the scope of the invention.

In an alternate method, severed lengths of drawstring longer than the width of an individual bag may be secured upon individual bags by the tape sections above described.

The invention enables the bags to be provided with individual drawstrings in a relatively high speed operation since no bag handling or manipulation is required beyond holding the bag on the conveyor belt.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of providing drawstrings on synthetic plastic bags comprising the steps of applying the leading end of a continuous length of flexible drawstring material to overlie the side surfaces of all of a plurality of spaced relatively limp empty closed plastic bags retained upon and lying flat on a surface adjacent the open ends of said bags, applying individual drawstring retainer tapes to overlie at least the major portion of the section of said drawstring length that is coextensive with the width of each bag, fixing each said tape to its respective bag while only freely laterally enclosing the associated section of drawstring length so that the drawstring length remains longitudinally movable with respect to said bags, and then severing said drawstring length intermediate each pair of adjacent bags whereby each bag operatively mounts a retained individual drawstring that extends therefrom at both ends of the retainer tape thereon.

2. The method defined in claim 1, wherein said bags are mounted in spaced relation on a movable conveyor while the drawstring and tape are being mounted thereon.

3. The method defined in claim 1, wherein said drawstring is severed substantially at the time each said tape is being fastened to a bag.

4. The method defined in claim 1 wherein each said tape is a length of tape wider than said drawstring and the tape is bonded to said side surfaces of the associated bag at opposite sides of the drawstring.

5. The method defined in claim 4, wherein each said tape is a strip of pressure sensitive tape that has a laterally intermediate region of its sticky surface all along its length that is non-sticky with respect to the drawstring.

* * * * *